United States Patent [19]

Svoma et al.

[11] Patent Number: 5,037,097

[45] Date of Patent: Aug. 6, 1991

[54] SPORTS RACKET

[75] Inventors: Rodney Svoma; James Speros, both of Phoenix, Ariz.; Gene A. Broadman, Livermore, Calif.

[73] Assignee: Athletic Alternatives, Inc., Phoenix, Ariz.

[21] Appl. No.: 233,228

[22] Filed: Aug. 18, 1988

[51] Int. Cl.[5] ..... A63B 51/06

[52] U.S. Cl. ..... 273/73 C; 273/73 R; 273/73 D

[58] Field of Search ..... 273/73 R, 73 C, 73 D

[56] References Cited

U.S. PATENT DOCUMENTS

| | | | |
|---|---|---|---|
| 1,687,848 | 10/1928 | Robinson et al. | 273/73 D |
| 3,582,073 | 6/1971 | Melnick et al. | 273/73 D |
| 4,449,353 | 5/1984 | Tayebi | 273/73 R |
| 4,664,380 | 5/1987 | Kuebler | 273/73 C |
| 4,802,678 | 2/1989 | Svoma | 273/73 D |

FOREIGN PATENT DOCUMENTS

| | | | |
|---|---|---|---|
| 899972 | 9/1944 | France | 273/73 R |
| WO88/01890 | 3/1988 | PCT Int'l Appl. | 273/73 R |
| 223151 | 10/1924 | United Kingdom | 273/73 D |
| 2191706 | 12/1987 | United Kingdom | 273/73 D |

*Primary Examiner*—Edward M. Coven
*Assistant Examiner*—Raleigh W. Chiu
*Attorney, Agent, or Firm*—Berthold J. Weis

[57] ABSTRACT

A sports racket having a stringed playing surface wherein selected ends of individual string segments meet the frame alternately in front of or behind the plane of the playing surface.

15 Claims, 4 Drawing Sheets

SPORTS RACKET

FIELD OF THE INVENTION

This invention relates to sports rackets, such as used for playing the games of tennis, racquetball, and squash, for example, and more particularly to sports rackets having a central playing surface of interwoven strings, which lie in a single plane but whose ends are secured to the racket frame in a splayed configuration, to provide dynamic behavior characteristics of a bilaterally concave surface, whose dynamic properties are also closely matched to the dynamic properties of balls intended to be struck thereby.

BACKGROUND OF THE INVENTION

Much work has been done to provide improved rackets for tennis and racquetball. The principal aim has been to provide rackets for achieving superior game performance, but another important concern has been to provide rackets which lessen the risk of injury, particularly damage to joints, e.g., tennis elbow. In the pursuit of improving the characteristics of rackets, much attention has been focused upon the stringed playing surfaces.

A prime example of earlier approaches by others is U.S. Pat No. 3,999,756, issued to Howard Head, which describes the famous and highly successful Head tennis racket. By careful experimental selection of a combination of size, geometry, mass, and materials, Head provides a racket with improved characteristics. However, the Head racket does not succeed in sufficiently improving the accuracy of balls which are struck off-axis.

In U.S. Pat No. 4,076,241, Newsome discloses a racket with an arrangement of strings providing a concave ball-engaging surface of dual string surfaces, intersecting each other along the center axis of the racket. Newsome's objective was to enable a player to maintain accuracy as the ball is hit away from the racket's sweet spot, while reducing twisting of the racket in the hand of the player. However, the dual string arrangement was not allowed by the U.S. Tennis Association for tournament play.

Another approach to enlarge the so-called "sweet spot" of the racket is disclosed in U.S. Pat. No. 4,330,132, issued to Ferrari. The central idea is to vary the tension of the individual string segments to make string deflection uniform in response to ball impact. However,, such rackets are exceedingly difficult to string.

Earlier tennis rackets had a generally narrower playing surface compared to modern rackets. Older tennis rackets also responded poorly to off-center axis hits, both in terms of "feel", as well as ball control. More modern rackets have a wider playing surface. Head, in particular, succeeded in enlarging the size of the "sweet spot", and hence improved the "feel" of off-center axis hits. However, control, especially in terms of elevation and direction of return shots for off-center axis hits remains a major issue for the wider rackets of today.

The present invention is the result of continued research, analysis, and extensive experimentation with tennis racket constructions aimed at further improvement in the playing characteristics and reduction of the torque transmitted to the player's hands and arms.

It is therefore an object of the invention to provide a racket with a string surface which provides improved control for off-center axis hits.

A still further object of the invention is to provide a racket construction which reduces the torque transmitted to the player's arm by spreading the energy of percussion over a larger period of time.

Another object of the invention is to provide a stringed surface which is planar but behaves dynamically as a bilaterally concave surface imparting an appropriate correcting vector to hit balls, but in a single planar surface weave and without doubling the webbing.

Still another object is to provide a racket having a strung surface whose dynamic behavior can more closely match the vibrational frequency of balls.

These and other objects are achieved by one or more of the following elements of racket construction.

SUMMARY OF THE INVENTION

The present invention provides a sports racket for tennis, racquetball, squash, or the like, having superior performance characteristics with respect to the racket being forgiving for not hitting the ball or target in the so-called sweet spot of the stringed surface, both in terms of accuracy and velocity of play, as well as deleterious anatomical effects, such as tennis elbow. The improved characteristics are achieved by modifying the manner in which the strings engage the peripheral frame of the racket. More particularly, the present racket exhibits an essentially planar webbing of a plurality of longitudinal and transverse interwoven string segments, selected ends of which engage the frame in front of or behind the plane of the stringed surface.

An earlier aspect of this work by co-inventor Svoma is the subject of a co-pending patent application Ser. No. 825541, now U.S. Pat. No. 4,802,678 whose disclosure is incorporated herein by reference. The present invention provides an improved string configuration which is comprised of but a single surface lying in a central plane, but exhibits characteristics of performance of a concave surface as a result of a novel suspension of the stringed surface as described in more detail below.

The present invention also improves the match of the dynamic mechanical properties of the racket to the equivalent properties of balls. While it is not possible to reduce the energy transmitted to a player's hand and arm, the dynamic properties of the present string configuration mitigate the magnitude of the torque exerted as a result of striking the ball by spreading the impulse over a longer time interval, and thereby reducing the instantaneous force levels transmitted to the player, hence reducing the risk of injury.

The preferred specific stringing arrangement comprises a set of lateral string sections perpendicular to the axis of grip, whose successive ends alternately engage the racket frame in front of and behind the plane of the playing surface. The optimum arrangement comprises an even number of longitudinal strings regularly interwoven with said lateral string segments, because in such an arrangement the two ends of any individual lateral string segment engage the frame in an opposing configuration, i.e., one in front of, the other behind said plane, providing more uniform characteristics to the racket surface. The net effect of the stringing arrangement is to provide a single, static surface defined by the weave of the strings, but which dynamically acts as two concave surfaces, because of the manner in which the individual strings are secured to the frame. The splayed configuration of the ends of the string essentially defines shallow pleats near the periphery and outside the ball contact area of the string surface.

The present arrangement of the suspension of the strings provides a surprising dynamic effect on ball control and playing characteristics of the racket even for hits in the peripheral regions near the edge of the frame. Although the surface is statically essentially flat, upon off-center impact by a ball, the string segment which is secured to the frame in front of said plane dynamically predominates in the interaction with the ball. This string segment is exposed to a larger fraction of the impact forces and hence greater stress. It responds by exhibiting greater strain, which results in laterally extending the area of the sweet spot. Also, because this string segment is anchored to the frame in front of the plane of the playing surface, its geometry imparts to the struck ball an important geometric correction vector toward the perpendicular through the center of the playing surface, this correcting vector also increases with increasing distance of the impact point from the center axis, applying progressively greater corrections to worse off-center hits, as they cause progressively greater twisting effects on the player's hand and forearm.

DESCRIPTION OF THE PREFERRED EMBODIMENTS

Figure 1:
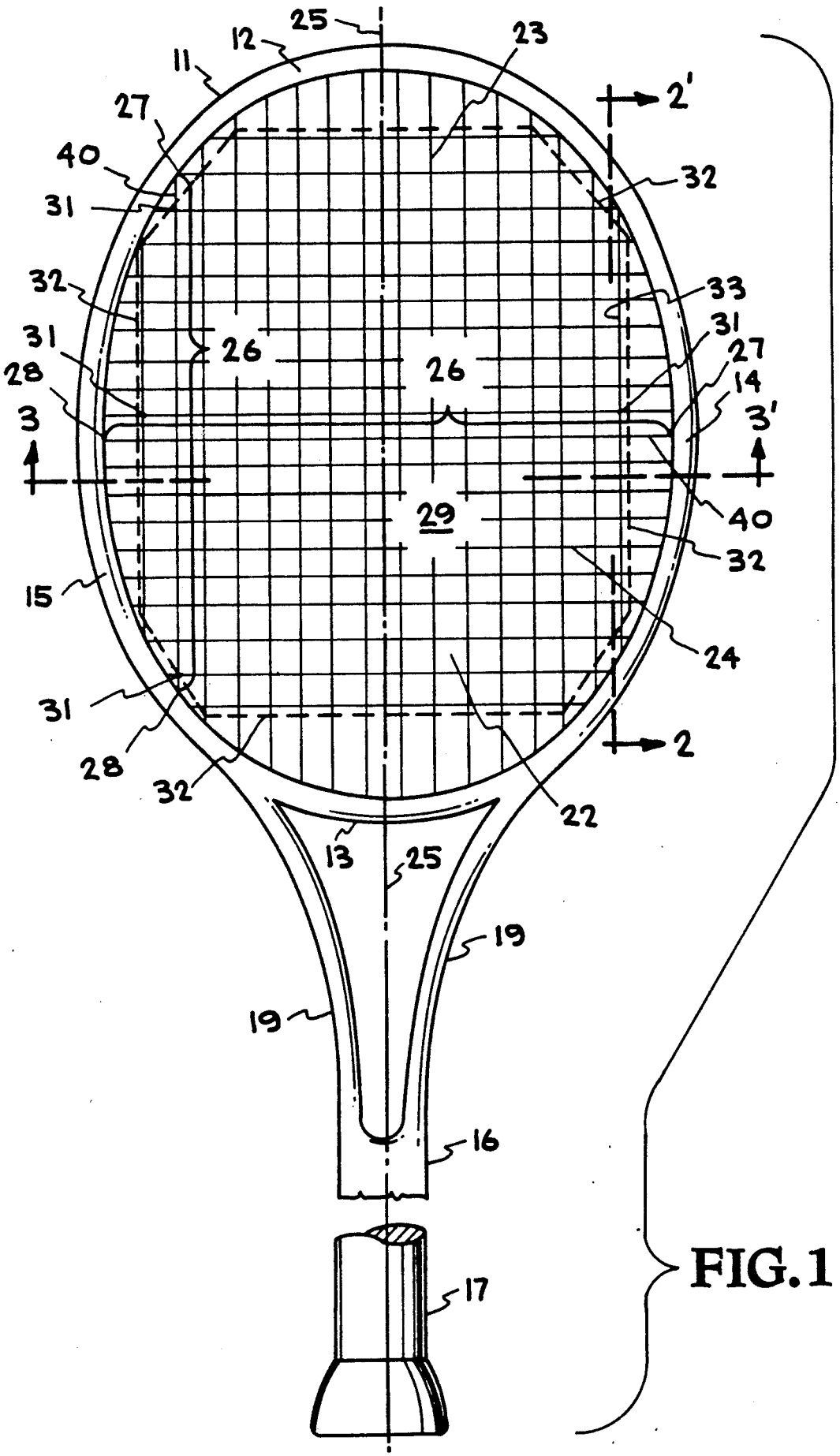
FIG. 1 is a plan view of a preferred tennis racket which exemplifies this invention.

Referring now to the drawings, particularly in FIG. 1, there is shown a tennis racket having a frame 11, generally elliptical, made of metal or fiber composite, having tip section 12, heel section 13, and lateral sections 14 and 15 respectively. A handle 16 with grip 17 is connected to elliptical frame 11 by way of arms 19 which are integral with and extend from the heel section 13 of the frame to the handle 16.

While the drawings show a conventional elliptical racket, it should be understood that the salient aspect of the invention relates to its stringing system which could also be used with other racket frames. Indeed, it is contemplated to also provide a modified frame, especially adapted to support and cooperate with the present stringing system as discussed below.

The elliptical frame holds strings which may be conventional synthetic or natural fiber. The type of webbing 22 shown in the drawings is formed by interweaving longitudinal strings 23 and lateral strings 24, respectively, parallel and at right angles to racket axis 25. The general weave of longitudinal strings and orthogonally interwoven lateral strings is preferred, however the present invention is equally applicable to stringing arrangements where the strings are disposed in different directions and intersect at other than right angles.

We will use the term string segment to refer to a length of string 26 between the points of contact 27 and 28 of the string segment with frame 11. By the term end, we shall mean that part of a string segment between the last point of contact or node 31 between a longitudinal and lateral string segment and the frame 11. One may thus consider the string configuration to be a three-dimensional spring comprised of a planar central interwoven area 29 within dotted line 32 and string segment ends 40 extending therefrom, secured to the frame to generally suspend the interwoven string area in the center of the frame. The area 29 is the general planar ball contact playing area. The area between area 29 and the frame is not considered as a ball contact area, since it is too close to the frame.

While we use the term string segment, it should be understood that the racket may be strung with one continuous string. A preferred arrangement is to use two strings, one for forming the laterally oriented segments, the other for the longitudinal segments. It is also not intended to preclude use of a plurality of strings of the length of individual segments, individually anchored to the frame, such as taught by Ferrari cited above.

Figure 6B:
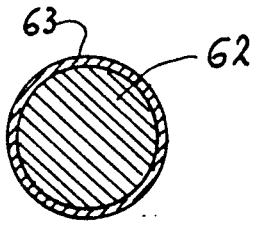
FIG. 6*b* shows a coated metal wire string in cross-section.
Figure 6A:
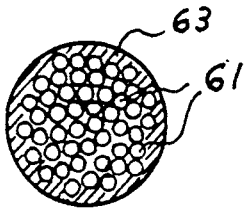
FIG. 6*a* is a cross-section of a multifilamentary coated string.

A variable parameter relates to the spacing between strings. This parameter is determined by the nature of the string used. The present invention applies to any choice of string material. The present racket may, however, be especially suited for using strings of uniform smaller diameters and closer spacing, because the ball will then contact and distribute the impact load over a larger number of strings. Such strings could, for example, be metallic, synthetic fiber, or plastic covered metallic core materials, particularly multifilamentary metallic core strings detailed cross-sectional views of which are shown in FIGS. 6*a* and 6*b*, with numerals 61 and 62 referring to multifilamentary and solid cores, respectively, surrounded by plastic coating 63. It may be particularly desirable to employ a combination of one type of string material for the lateral string segments and another for the longitudinal ones. The spacing between the string segments may also be greater near the frame than in the center of the stringed surface.

Figure 2:
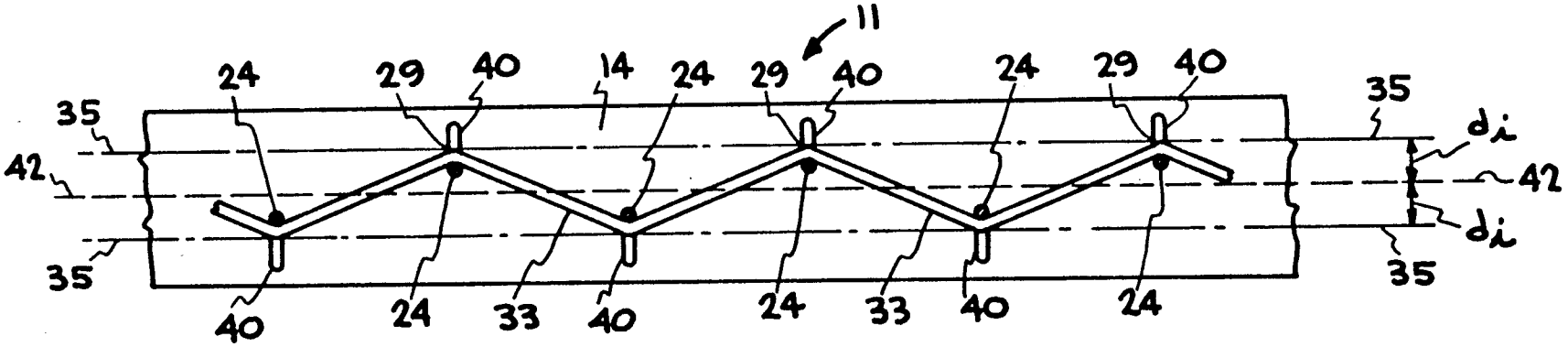
FIG. 2 is a cross-sectional view parallel to the center axis of the racket which shows the geometry of the longitudinal string nearest the side of the racket frame and successive lateral string segments engaging the side of the frame. The distances of the strings from the central plane are, however, exaggerated for sake of clarity.

The principal feature of the invention becomes more apparent from inspection of FIG. 2, which is a cross-section of the plan view of FIG. 1 along the 2,2′ plane with a view of lateral section 14 of frame 11. Dotted line 42 indicates the location of the center plane through the racket. The numerals 24 indicate the lateral strings contacting the last longitudinal string 33 next to the side of frame 11, forming nodes 29 defining the ends 40 of the string segments. The ends 40 of the lateral strings 24 are alternately anchored to the frame 11 at points above and below the center plane 42 at a distance $/d_i/$ therefrom. The distance $/d_i/$ is thus the measure of the distance from the center plane at which the ith string end is anchored. Since the important objective is to correct for elevational trajectory errors, it is preferred to flare the ends of lateral strings only, most preferred is that $d_i$ vary continuously between a maximum of $d_i = \frac{1}{2}$ inch in the center, to zero for the last lateral strings near the tip and the heel of the frame.

In the static configuration, the tension imparted on the lateral strings deforms the last longitudinal string into a undulating configuration (for sake of clarity, the undulation has been exaggerated in the drawing). Under static conditions the excess deformation may be less than a string diameter. The area 29 of the string surface in therefore essentially flat, except for the perturbation introduced by the normal weave and the flared end suspension effect on the strings closest to the periphery of area 29. Broken lines 35 connect the high and low points of the last longitudinal string. The undulating last longitudinal string indicates the geometric nature of the surface defined by the strings in toto—i.e., pleated at the periphery.

Figure 3:
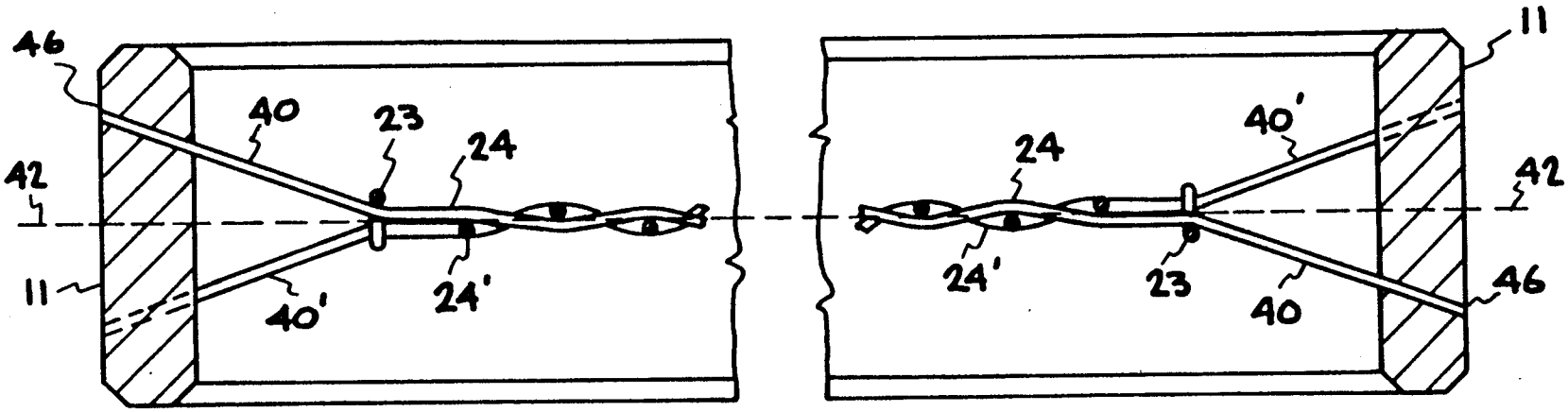
FIG. 3 is a cross-sectional view across a preferred racket parallel to a lateral string, showing the geometry of an individual lateral string segment. Again, for illustrative purposes, the strings near the frame are further from the center plane than in reality.

FIG. 3 is a cross-section along plane 3,3' through the plan view i FIG. 1, showing the preferred configuration of a lateral string 24. Longitudinal strings 23 located nearest to the frame 11 are shown somewhat out of the central plane indicated by broken line 42, again somewhat exaggerated for clarity. Numeral 24' refers to the next lateral string, the vertical locus of which is essentially symmetrically opposite to proximal string 24. This drawing clearly shows the splayed or flared relationships of the ends of the lateral string segments 24 and 24'.

In the center of the racket, the playing surface behaves as in conventional rackets. However, as balls contact the racket farther and farther away from the center axis, the influence of the lateral string anchored to the frame behind the center plane is progressively reduced, and the dynamic behavior of the racket string surface tends to approach those of a racket strung with fewer, and in the limit, one half the of lateral strings. Hence, the farther hit toward the sides of the racket, the greater the deflection of the weave, because the effective number of interacting strings is reduced by the nature of the flared spring end suspension.

The strings may be anchored to the frame in a conventional manner, i.e., drillings or holes 46 through the frame 11 of the racket at the appropriate locations. The strings may also be wound around the racket frame 11, held in place by grooves or recesses in the surfaces of the racket frame.

Figure 4A:
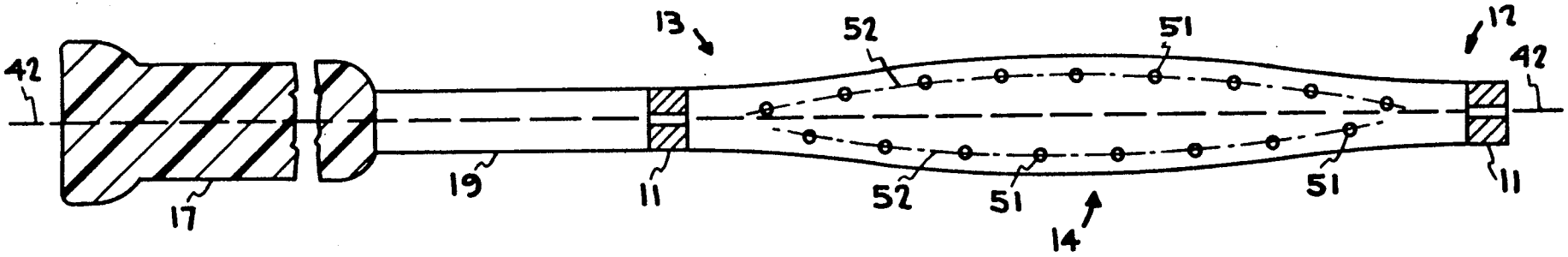
FIGS. 4*a* and 4*b* are cross-sectional views of preferred frames having widened frame sections to accommodate mounting of the ends of the strings at enhanced angles of flare in the center of the lateral sections of the frame, and over the entire frame.

FIG. 4*a* is a cross-section of a preferred racket frame through its central axis 42, having a handle 17, arms 19 extending from said handle to generally elliptical racket frame 11. The significant feature of the racket frame 11 is that its side sections 14 are widened in order to permit a pattern of drillings 51 at a greater distance from the center plane than would be possible with the racket frames of conventional width, hence providing support for lateral strings whose ends are anchored to the frame at a greater degree of flare or splay than would otherwise be possible. The width contour of the side sections 14 of the racket frame preferably corresponds to the distance contour 52 of the chosen pattern of flare for the drillings 51 for receiving the string segment ends, i.e., widest in the center of the side sections, up to about the width of the handle, and gradually diminishing in width of the frame towards the tip and heel sections 12 and 13 respectively.

Figure 4B:
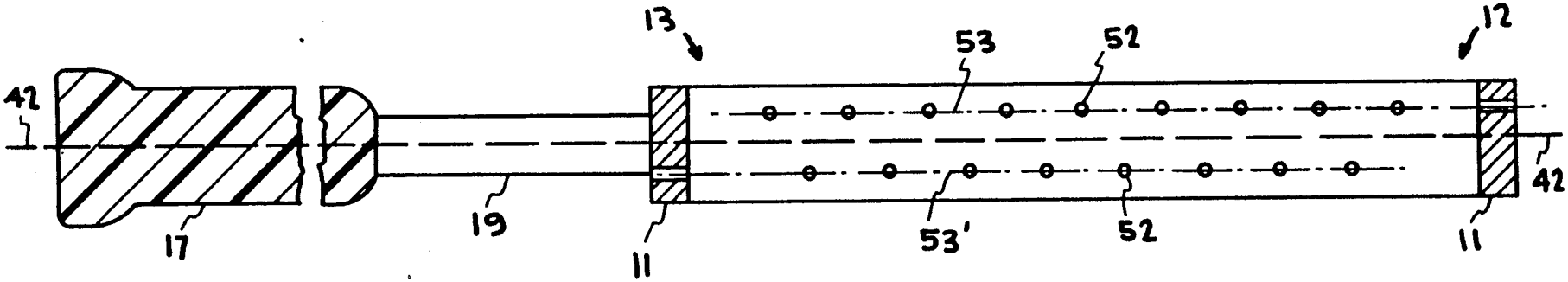

FIG. 4*b* shows a racket frame, identical to the frame shown in FIG. 4*a*, except that heel and tip sections 12 and 13 are also widened to provide support for anchoring the ends of longitudinal strings at enhanced distances from the center plane as well. In this variation the drillings 52 are alternately located in planes 53 and 53' in front of our behind the center plane at a more or less constant distance therefrom.

The tension applied to the strings may be constant over the entire racket, i.e., identical for the longitudinal and lateral strings, about 45–75 lbs. depending on player preference and ability and racket diameter. It is, of course, necessary that for any string the tension which it will experience under maximum ball impact will remain below Hooke's limit for the string material.

In the foregoing section we set forth the geometric characteristics and experimental performance data for out new sports racket. The physics and physiology of racket games such as tennis and racquetball, for example, are very complicated. There are, however, certain principles which are reasonably well established and which may provide some insight or explanation why the present racket exhibits its improved performance.

Figure 5:
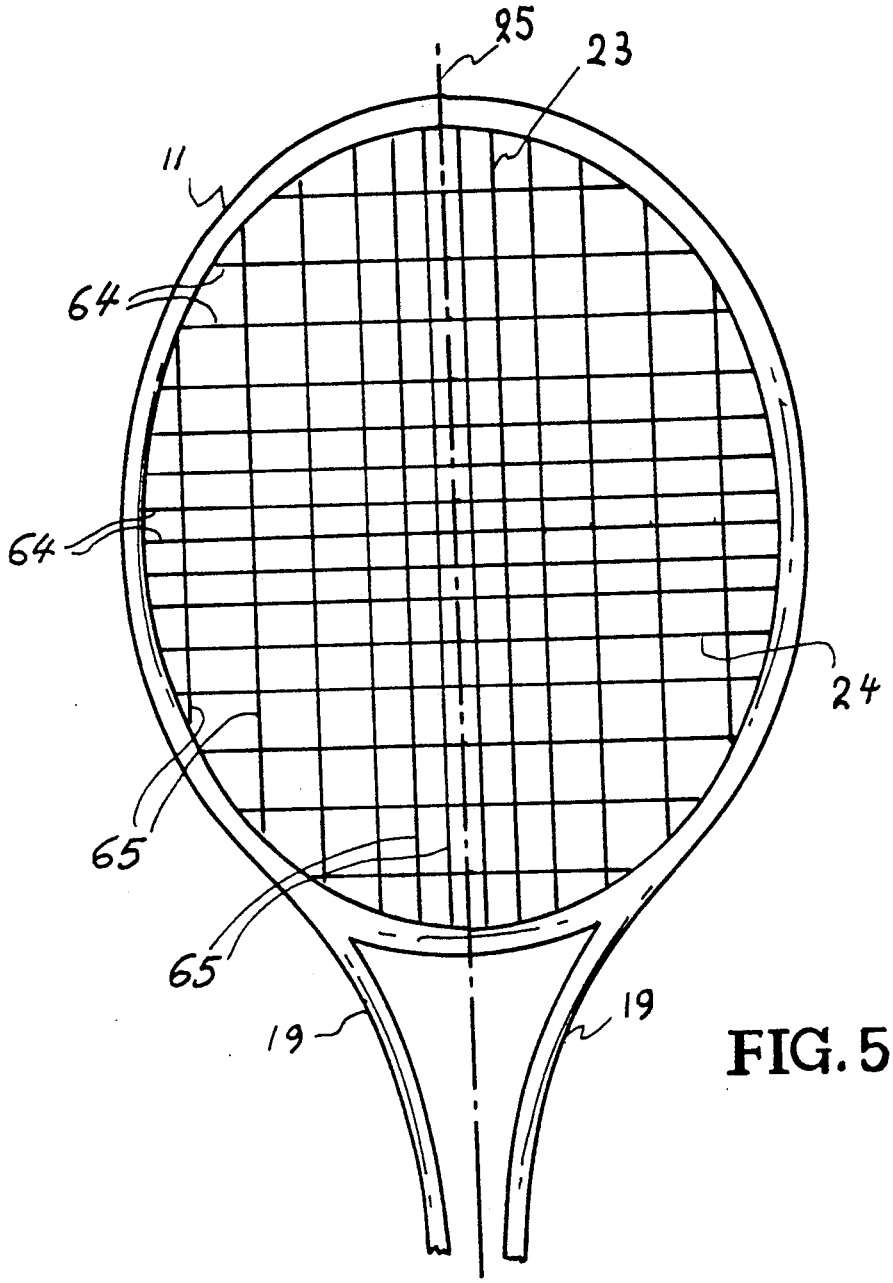
FIG. 5 is a plan view of a tennis racket, wherein the spacing between adjacent string segments is greater near the frame than in the center of the string surface.

The first of these is the geometry of the present racket's playing surface which we believe is principally responsible for the improved accuracy of delivery of a ball which is struck by the racket in an off-center axis location. Other things being equal, it can be shown mathematically that the present string suspension system acts as a three-dimensional spring, which in the course of its return from maximum deformation by ball impact, imparts a lateral component of force to the ball, vectoring its trajectory toward what it would have been had the ball been struck in the center of the playing surface. The second consideration is the present method of alternately anchoring the strings to the frame in front of and behind the plane of the playing surface modifies the spring characteristics associated with the areas of the string webbing away from the center. The coupling between the ball and the racket is determined by the summed response of the individual strings contacted by the ball over the time interval between initial contact and final separation of ball and playing surface. As the area of impact moves toward the periphery, the number of strings effectively interacting with the ball is decreasing because the strings which are anchored to the frame behind the plane of the playing surface interact with the ball progressively later and less in the course of the impact time history. The progressive reduction in the number of strings effectively interacting with the ball, as impacts take place closer to the frame, compensates for the stiffening influence due to the fact that the strings through the peripheral areas are shorter. Therefore, the racket of this invention maintains more consistent coupling, or "feel" over a larger area of the stringed surface than conventional rackets. Figure 5 shows a racket wherein adjacent lateral and longitudinal string segments 64 and 65 are spaced closer together near the center of the racket than near the periphery.

The third factor, reduced deleterious physiological effects, is achieved because the torque is reduced. The reduction of the torque exerted on the arm anatomy of the player as a result of off-axis hits results from spreading the energy over an extended time interval by reducing the effective number of interacting strings so their length decreases, thus increasing their deflection and prolonging the time interval during which the ball remains in contact with the racket.

TEST DATA FOR A PREFERRED RACKET

Rackets constructed in accordance with the concepts of the present invention were subjected to numerous tests. One test strategy employed was to comparison test the present racket with various other conventional rackets under identical conditions.

In these tests, care was taken to devise a test apparatus to provide a capability of simulating as closely as possible the human player elements as well as game conditions. For example, in the course of play, a player will attempt to return the ball in a certain direction at a certain velocity and trajectory. The critical inquiry is to ascertain what will happen to the trajectory if the player fails to hit the ball with the racket center.

The test setup dubbed IRON IVAN employed a leaf spring arm with clamping means for holding a racket at the handle. The other end of the leaf spring was firmly secured to a vertical spring mechanism. The length and width of the spring were chosen to closely resemble the length of a human arm and to permit a degree of torsion about the longitudinal axis of the spring resembling the effect of twisting produced by off-axis hits. A latch mechanism was provided to hold and release the leaf spring from a retracted loaded position to enable execution of reproducible strokes, to produce ball speeds between 20 and over 100 mph. The target ball was supported by a break away tee. Ball impacts were recorded on aluminum foil disposed on a flat vertical surface at distances of 20 and 30 feet from the launch mechanism.

A typical series of tests would have Ivan hit a series of 25 shots directly in the center of the string face, 25 shots above, and 25 shots below the center of the string face geometrical center. The ball is hit into a concrete wall 20 feet in front of Ivan, and each ball hit is recorded by making an imprint on sensitized foil. By knowing the exact height of the ball at the racket contact point and knowing the exact height at the wall impact point, we can accurately determine the initial velocity (initial energy imparted into the ball by the racket) and the azimuthal directional that the ball was hit.

We have tested our invention and compared it against test data derived from identical tests conducted on some of the most popular rackets on the market. The following table is a summary of test results using out preferred racket, comprising 19 lateral strings and 16 longitudinal strings, with a $d_i$ for the lateral strings progressively varying from a maximum of 0.2 inch for the center strings to zero for the lateral strings nearest the tip and the heel of the racket. All tests were conducted with rackets of 90 square inches of string area and 55 pound tensioned strings.

| Racket ID | Center Hit | Above Center Hit | Below Center Hit | Spread in Inches | Angular Error |
|---|---|---|---|---|---|
| Prince Pro | 13.65 | 16.11 | 10.15 | 5.96 | 1.4 degrees |
| Antelope | 12.23 | 15.56 | 8.83 | 6.76 | 1.6 degrees |
| Wilson Profile | 14.36 | 15.98 | 11.61 | 4.37 | 1.0 degrees |
| Prince Response | 13.06 | 15.27 | 10.89 | 4.38 | 1.0 degrees |
| Our Racket | 12.24 | 13.79 | 11.77 | 2.02 | 0.48 degrees |

For a baseline to baseline volley at a distance of 80 feet, the spread error would be 8 inches for the Svoma, 24 inches for the Prince and 27 inches for the Antelope.

Having thus described the invention, it will be obvious to those skilled in the art that numerous modifications may be made, such as varying the spacing, tension, materials of the string, without departing from the spirit and scope of the present invention.

We claim:

1. A sports racket, comprising:

a peripheral frame having tip, heel, and side portions disposed in and about a central plane of symmetry; said tip, heel, and side portions having a width in a direction perpendicular to said plane of symmetry;

a handle with a grip thereon extending from and secured to the heel of said frame;

a first plurality of string segments extending across said central plane between opposite locations of said frame in a first direction;

a second plurality of string segments extending across said central plane between opposed locations of said frame in a second direction;

said first and second direction being at an angle with respect to each other, and said first and second plurality of string segments being interwoven into a planar webbing defining a ball contact area in said central plane within said frame;

each of said string segments having two ends, a first of said ends extending in a first direction between the periphery of said contact area and a proximate location on said frame, and the second of said ends extending between the opposite side of the periphery of said ball contact area to a proximate location on said frame in a direction opposite to said first direction;

where at least said first ends of at least said first plurality of string segments are secured to said frame at a distance $d_i$, where $d_i$ is the perpendicular distance between the central plane and the location on said frame to which the ith string end is secured, i designating the order of the ith string end in the sequence of adjacent first string ends of said first plurality of string segments, the distance $d_i$ being alternately measured in opposite directions from said central plane, and where said distance $d_i$ varies between a minimum distance for the first and last string ends in said sequence and a maximum distance for a string end between said first and last string ends in said sequence.

2. The sports racket of claim 1 further defined in that said first and second plurality of string segments comprise (a plurality of) longitudinal strings extending between the tip and the heel portions of said frame and (a plurality of) lateral strings extending between the side portions of said frame.

3. The sports racket of claim 2, wherein said ends of said string segments which were alternately secured to said frame at locations at a distance $d_i$ in front of and behind said plane are the ends of lateral string segments.

4. The sports racket of claim 3 wherein the number of longitudinal strings is even.

5. The sports racket of claim 1, wherein $d_i$ is up to about ½ inch.

6. The sports racket of claim 1, wherein the width of said frame is up to about the width of said handle.

7. The sports racket of claim 1, wherein the spacing between string segments is greater near the frame than in the center.

8. The sports racket of claim 1, wherein said string segments are comprised of metal wire.

9. The sports racket of claim 8, wherein said wire is coated.

10. The sports racket of claim 9, wherein said wire is multifilament wire.

11. The sports racket of claim 1, wherein the lateral string segments are formed from one continuous string and the longitudinal segments are formed from another continuous string.

12. The sports racket of claim 11, wherein said lateral string segments and said longitudinal string segments are individually tensioned.

13. The sports racket of claim 1, wherein the string segments are individually anchored and tensioned.

14. A sports racket comprising:

a peripheral frame having tip, heel, and side portions disposed in and about a central plane of symmetry, said tip, heel, and side portions of said frame having a width in a direction perpendicular to said central plane of symmetry, said width at a given place of the periphery of said frame being greater than twice a distance $d_i$;

a handle with a grip thereon extending from and secured to the heel of said frame;

a plurality of an even number of longitudinal string segments extending between the tip and heel portions of said frame, and a plurality of lateral string segments extending between the side portions of said frame, said string segments being interwoven to define a ball contact playing surface lying generally in said central plane within a region defined by said peripheral frame;

each of said lateral string segments having end sections extending from the periphery of said playing surface to a location on said frame a distance $d_i$ perpendicularly from said central plane alternately in front of and behind said plane for successive adjacent ends;

wherein said distance $d_i$ perpendicularly from said plane of symmetry to the location the side portions of said frame to which an end of the ith lateral string is secured varies continuously between minimums as small as about zero for the ends of lateral strings near the tip and heel portions of said frame, and a maximum of up to about ½-inch for the ends of lateral string segments near the center of said side portions of said frame.

15. The sports racket of claim 14, wherein the width of the side portions of said frame are up to about the width of said handle, having a maximum width near the center of said side portion, with said width gradually diminishing toward said tip and heel portions in conformity with the decreasing magnitude of $d_i$.

* * * * *